United States Patent [19]

DeGooyer

[11] Patent Number: 4,899,512

[45] Date of Patent: Feb. 13, 1990

[54] SPACER AND FABRIC MESH REINFORCEMENT MEMBER FOR GLASS BLOCK MASONRY INSTALLATION

[76] Inventor: Lonnie C. DeGooyer, 349 E. 5600 South, Murray, Utah 84107

[21] Appl. No.: 154,238

[22] Filed: Feb. 10, 1988

[51] Int. Cl.[4] ..... E04B 1/62

[52] U.S. Cl. ..... 52/396; 52/308; 52/442; 428/256

[58] Field of Search ..... 52/306, 307, 396, 127.3, 52/127.4, 438, 442, 417; 428/255, 256

[56] References Cited

U.S. PATENT DOCUMENTS

| | | | |
|---|---|---|---|
| 2,110,628 | 3/1938 | Leiser | 52/307 X |
| 2,157,038 | 5/1939 | Unverferth | 52/396 |
| 2,346,170 | 4/1944 | Kalkusch | 52/308 |
| 3,234,699 | 2/1966 | Smith | 52/308 X |

*Primary Examiner*—Carl D. Friedman
*Assistant Examiner*—Creighton Smith

[57] ABSTRACT

A spacer and fabric mesh reinforcement member for use in laying of glass blocks to form unique wall structure is disclosed. The spacer and fabric mesh member takes the form of an elongate slab having two strips of fabric mesh attached to the respective upper and lower surfaces of the slab. One of the strips of fabric mesh extends outwardly from the first end of the slab adjacent to the upper surface of the slab, and the second strip of fabric mesh extends outwardly from the second end of the slab adjacent to the lower surface of the slab. When the spacer and fabric mesh members are embedded in the lateral joints between courses of blocks, the members are positioned end-to-end, and the extending ends of the strip of fabric mesh cover the butts between the members. When the spacer and fabric mesh members are embedded in the vertical joints between blocks, the extending ends of the strip of fabric mesh are bent back in mutually opposite directions to overlie the top of one adjacent block and to underlie the bottom of the other adjacent block.

10 Claims, 2 Drawing Sheets

SPACER AND FABRIC MESH REINFORCEMENT MEMBER FOR GLASS BLOCK MASONRY INSTALLATION

BACKGROUND OF THE INVENTION

1. Field of the Invention

The present invention relates broadly to an improvement in masonry installation of glass blocks which are laid in successive, superimposed courses to form a wall structure. In particular, the invention relates to novel, unique spacer and fabric mesh reinforcement members which are positioned horizontally between the courses of glass blocks as well as vertically between adjacent, side-by-side glass blocks as the wall structure comprising the glass blocks is being laid up by the mason.

2. State of the Art

It is well known in the prior art to provide spacers and reinforcement members in the mortar between glass blocks as the mason forms layer upon layer of the blocks. A search the patent literature produced the following U.S. Pat. Nos.:

2,124,799 to C. H. Specht, dated 7/26/1938;

2,157,038 to G. A. Unverferth, dated 5/2/1939; and 2,346,170 to R. Kalkusch, dated 4/11/1944.

The patent to Specht discloses a reinforcing member adapted to be embedded in the mortar bed between glass building blocks. The reinforcing member comprises a wire grid made of longitudinal and transverse wires which are welded at their points of intersection. The wire grid of U.S. Pat. No. 2,124,799 is relatively costly and does not aid the mason in spacing the glass blocks during installation. However, similar type reinforcement members have been used extensively in the trade to provide increased strength to the wall construction.

The patent to Kalkusch shows a very complicated wall construction in which a cubicle-forming superstructure is made of precast concrete slabs. The slabs are laid in horizontally rows, with shorter vertical slabs spaced along a lower row to form equally spaced cubicles and to support the horizontal slabs in an upper row. Means are provided for keying the vertical slabs into a conventional masonry wall immediately behind the cubicle-forming superstructure to support the superstructure formed by the horizontal and vertical slabs. After the superstructure has been formed, glass blocks are positioned within the cubicles formed by the superstructure. Although the blocks are spaced evenly in the resulting wall structure, the system proposed in Pat. No. 2,346,170 would be prohibitively expensive and labor intensive due to the cumbersome construction of the superstructure. The system has not been used in the trade most likely because of its costly and cumbersome installation.

The patent to Unverferth discloses a spacer and seal member for glass wall construction. The spacer and seal member consists of an elongate, flexible and compressible core and a wire grid or screen wrapped completely about the core to hold the core together. A coating of sticky adhesive material is applied to the surface of the wrapped core. The adhesive is used to adhere the spacer and seal to the glass blocks, with the spacer and seal being installed between the blocks in place of conventional mortar as the wall is being constructed. A small groove is left at the exposed face of the wall construction, and a grout is applied in the groove to hide the spacer and seal positioned between the blocks. The spacer and seal of U.S. Pat. No. 2,157,038 is relatively costly to make and must be carefully handled during shipping and storage of the units as well as during construction of the wall because of the sticky adhesive applied to its outer surfaces The spacer and seal cannot be used with conventional mortars used by masons in constructing masonry walls, and possibly because of this, the spacer and seal of U.S. Pat. No. 2,157,038 have not found wide use in the trade.

OBJECTIVES

A principal objective of the invention is to provide a novel spacer and fabric mesh reinforcing member for use by a mason in constructing a wall made of glass blocks, wherein the spacer and reinforcing member is adapted to be used with conventional mortar and aids the mason in quickly laying up the glass blocks with uniform spacing and alignment, and further wherein the spacer and reinforcing member provides a novel fabric mesh reinforcement which ties the laid up blocks together with greatly improved strength and structural stability.

An additional objective of the present invention is to provide a novel wall construction comprising glass blocks which are laid up with the unique spacer and reinforcing members of the present invention.

BRIEF DESCRIPTION OF THE INVENTION

The above objectives are achieved in accordance with the present invention by providing a novel, unique spacer and fabric mesh reinforcement member for use in the construction of a masonry wall made of glass blocks. The novel member of the present invention comprises an elongate slab of a resilient, compressible material which has substantially flat upper and lower surfaces, lateral side edges, first and second end edges and a desired thickness sufficient for the slab to act as a spacer between the glass blocks in the wall construction.

A first, elongate piece of fabric mesh is provided to lay flat along the upper surface of the slab. The first piece of mesh has first and second, lateral sides and opposite, first and second ends. The width of the first piece of mesh is no greater than the dimension between the lateral side edges of the slab. The first piece of mesh is adhered to the slab so as to lie flat against the upper surface thereof. The longitudinal length of the first piece of mesh is significantly greater than the longitudinal distance between the end edges of the slab, with the first end of the first piece of mesh being positioned closer to the first end of the slab than to the second end thereof. The second end of the first piece of mesh extends outwardly from the second end edge of the slab.

A second, elongate piece of fabric mesh is provided to lay flat along the lower surface of the slab. The second piece of mesh has first and second, lateral sides and opposite, first and second ends. The width of the second piece of mesh is no greater than the dimension between the lateral side edges of the slab. The second piece of mesh is adhered to the slab so as to lie flat against the lower surface thereof. The longitudinal length of the second piece of mesh is significantly greater than the longitudinal distance between the end edges of the slab, with the first end of the second piece of mesh being positioned closer to the second end of the slab than to the first end thereof. The second end of the second piece of mesh extends outwardly from the second end edge of the slab.

Thus, the spacer and fabric mesh reinforcement member of the present invention takes the form of an elongate slab having two strips of fabric mesh attached to the respective upper and lower surfaces of the slab. One of the strips of fabric mesh extends outwardly from the first end of the slab adjacent to the upper surface of the slab, and the second strip of fabric mesh extends outwardly from the second end of the slab adjacent to the lower surface of the slab.

In a first preferred embodiment of the spacer and fabric mesh reinforcement member, the slab component thereof has a longitudinal length at least twice the horizontal length of the individual glass blocks being used to form the wall structure. These first embodiments of the spacer and fabric mesh reinforcement members are used by being embedded with a conventional thin set mortar in end-to-end relationship between courses of glass blocks in the wall structure. The mortar firmly holds the courses of blocks and the horizontally disposed and embedded spacer members together as a solid wall structure.

The slabs of the horizontal spacer and fabric mesh members are placed in abutting, end-to-end relationship between the courses of glass blocks as the wall structure is being laid. The extending second end of the first piece of fabric mesh of each respective slab extends over and lies flat on the upper surface of a mutually respective adjacent slab to cover the juncture between the upper surfaces mutually adjacent, abutting slabs. Likewise, the extending second end of the second piece of fabric mesh of each respective slab extends over and lies flat on the lower surface of a mutually respective adjacent slab to cover the juncture between the upper surfaces of the mutually adjacent, abutting slabs. There is thus provided a spaced double row of continuous fabric reinforcement along the entire length of the horizontal mortar joints between courses of the glass blocks.

In a second preferred embodiment of the spacer and fabric mesh reinforcement member, the slab component thereof has a longitudinal length which is no greater than the vertical height of individual glass blocks being used to form the wall structure. These second embodiments of the spacer and fabric mesh reinforcement members are used by being embedded vertically with a conventional thin set mortar between adjacent glass blocks in the wall structure. The extending portion of the piece of fabric mesh at the upper end of each vertically positioned slab is bent in a substantially right angle with respect to the slab to lie along the upper surface of one of the adjacent glass blocks, and the extending portion of the piece of fabric mesh at the lower end of each vertically positioned slab is bent in a substantially right angle with respect to the slab to extend in the opposite direction to the extending portion of fabric mesh at the upper end of the slab. Thus, the extending portion of the fabric mesh at the lower end of the slab lies along the lower surface of the opposite adjacent glass block. This ties the entire wall structure into a strong, stable condition.

The spacer and fabric mesh reinforcement members of the present invention allows the mason to quickly erect the wall structure, with the glass blocks all being spaced evenly. Multiple courses of glass blocks can be laid at the same time inasmuch as the spacers prevent the mortar from being pushed out of the horizontal joints between lower courses of glass blocks in the wall structure.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which:

FIG. 1*a* is an exploded pictorial of the two preferred embodiments of the spacer and reinforcement members of the present invention as they would be oriented in a wall structure formed of glass blocks, but for simplicity, the glass blocks are not shown in the drawing;

DETAILED DESCRIPTION OF THE ILLUSTRATED EMBODIMENTS

As mentioned previously, the present invention relates to the laying of glass blocks in a masonry wall. In particular, the invention is directed to a spacer system which aids the mason in quickly laying up the glass blocks. Additionally, the spacer system includes a fabric mesh reinforcement which ties the laid up blocks of the wall construction together with more inherent strength than in conventional glass block construction.

Figure 1:
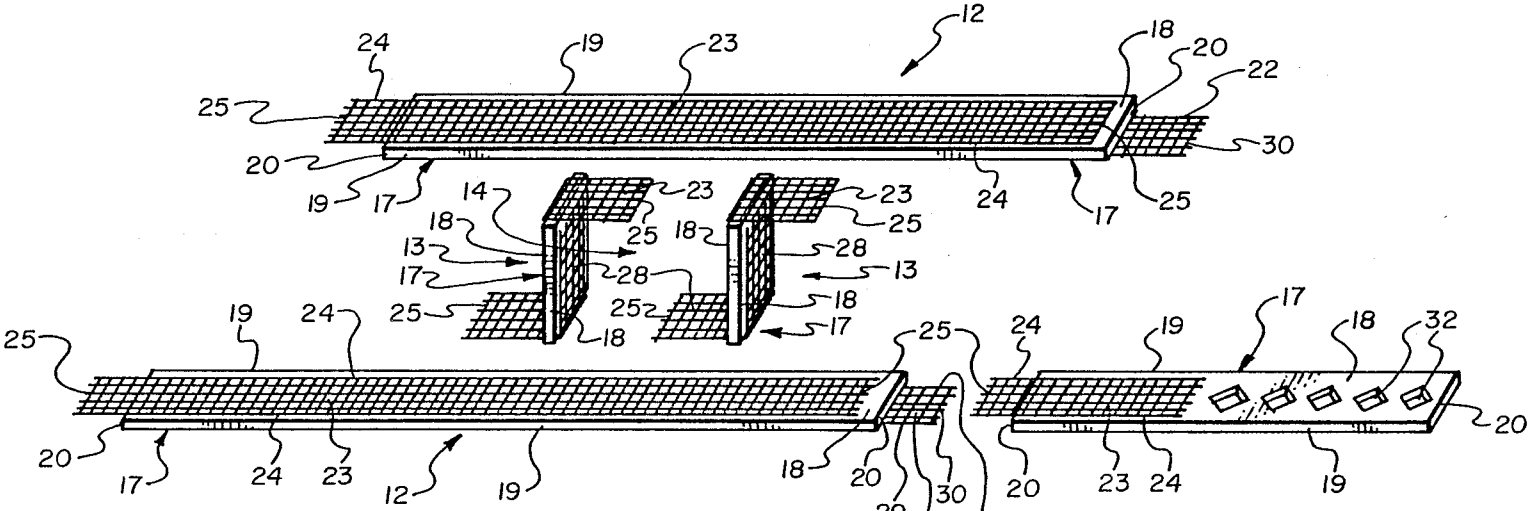

As shown in FIG. 1 of the drawings, the spacer and fabric mesh reinforcement system of the present invention comprises lateral spacer and fabric mesh members 12 which are to be positioned between rows of glass blocks. Vertical spacer and fabric mesh members 13 are similar to the lateral members 12, but are considerably shorter and adapted to be positioned vertically between adjacent glass blocks. A glass block would fit in the space shown by the number 14 in FIG. 1. The lateral spacer and fabric mesh members 12 have a longitudinal dimension which is at least twice the horizontal length of the individual glass blocks being used to form the wall structure. Preferably, the lateral spacer and fabric mesh members 12 will have a length of several feet, such as between about two and four feet. The vertical spacer and fabric mesh members 13 have a longitudinal dimension which is no greater than the vertical height of individual glass blocks being used to form the wall structure. Common glass blocks have a nominal vertical dimension of about 7.5 inches, and thus the vertical spacer and fabric mesh members 13 will preferably have a nominal length of about 7.5 inches.

Figure 2:
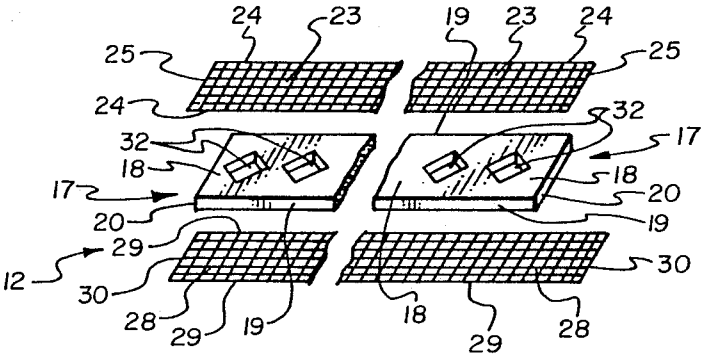
FIG. 2 is an exploded pictorial of one of the horizontal spacer and reinforcement members of FIG. 1.

As can be seen, the vertical and horizontal spacer and fabric mesh members 12 and 13 have identical construction, with the exception of their length. The construction of the spacer and fabric mesh members 12 and 13 will now be described with reference to FIGS. 1–3 of the drawings. The spacer and fabric mesh reinforcement members of the present invention comprise an elongate strip or slab 17 made of a resilient and compressible material such as foamed rubber and foamed plastics like foamed polystyrene.

The slab 17 has substantially flat upper and lower surfaces 18, lateral side edges 19, and first and second end edges 20. The slab has a thickness of the desired spacing between blocks, such as about one-fourth to one-half inch. The width of the slab is less than the width of the glass blocks. Glass blocks commonly have a nominal width of about four inches, and the width of the slab of the present invention is preferably between about two and three inches.

A first, elongate piece of fabric mesh 23 is adhered flatwise on the upper surface of the slab 17. Any conventional adhesive such as rubber contact cement can be used to adhere the fabric mesh to the slab. The fabric mesh 23 has first and second lateral sides 24 and opposite first and second ends 25. The width of the fabric mesh 23 is no greater than the dimension between the lateral side edges of the slab 17. The fabric mesh 23 has a longitudinal length which is significantly greater than the longitudinal distance between the end edges 20 of the slab 17. The first end of the fabric mesh 23 is positioned closer to the first end edge of the slab 17 than to the second end edge of the slab 17, and the second end of the fabric mesh 23 extends beyond the second end edge of the slab 17.

A second, elongate piece of fabric mesh 28 is adhered flatwise on the lower surface of the slab 17. Again, any conventional adhesive such as rubber contact cement can be used to adhere the fabric mesh to the slab. The fabric mesh 28 has first and second lateral sides 29 and opposite first and second ends 30. The width of the fabric mesh 28 is no greater than the dimension between the lateral side edges of the slab 17. The fabric mesh 28 has a longitudinal length which is significantly greater than the longitudinal distance between the end edges 20 of the slab 17. The first end of the fabric mesh 28 is positioned closer to the first end edge of the slab 17 than to the second end edge of the slab 17, and the second end of the fabric mesh 28 extends beyond the second end edge of the slab 17.

Figure 3:
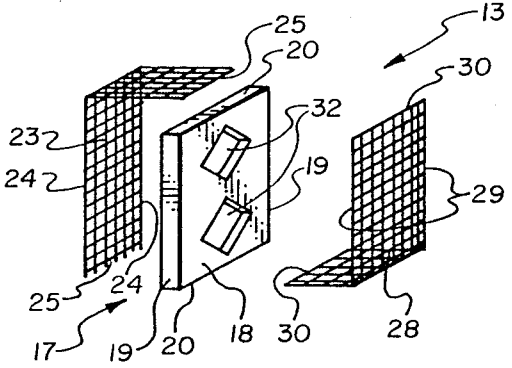
FIG. 3 is an exploded pictorial of one of the vertical spacer and reinforcement member of FIG. 1.

As can be seen in FIG. 1 and as described above, the fabric mesh 23 on the upper side of the slab 17 extends beyond one end of the slab 17, and the fabric mesh 28 on the opposite side of the slab extends from the opposite end of the slab. This allows the slabs 17 of the lateral spacer and fabric mesh members 12 to be abutted in end-to-end relationship, with the extending portions of the fabric meshes 23 and 28 covering the butts. The extending portions of the fabric meshes 23 and 28 of the vertical spacer and fabric mesh members 13 are adapted to be bent back in opposite directions as shown in FIGS. 1 and 3 to lie against the mutually respective lateral spacer and fabric mesh members 12 of the constructed wall structure.

In a preferred embodiment of the invention, the slabs 17 of the spacer and fabric mesh reinforcement members are provided with at least two spaced openings 32 along the longitudinal length of the slabs, with the openings 32 extending through the slab 17 from the upper surface to the lower surface thereof. The openings 32 allow continuity in the mortar between the opposite sides of the slabs 17. The resilient nature of the slabs 17 allows the glass blocks to expand and contract under different atmospheric conditions without developing destructive stresses in the individual blocks. For large wall structures in which the expansion and contraction can be a problem, it is advantageous to use spacer and fabric mesh reinforcement members in which the slabs 17 do not have openings 32. Breaking the continuity of the mortar in the joints of the structure allows optimum contraction and expansion of the glass blocks. To obtain maximum strength where expansion and contraction is not a problem, it is advantageous to use the spacer and fabric mesh members in which the slabs are provided with the openings 32. The openings 32 can be of any shape, such as the diamond shape shown in FIGS. 1–3 and the circular shape shown in FIG. 4.

Figure 4:
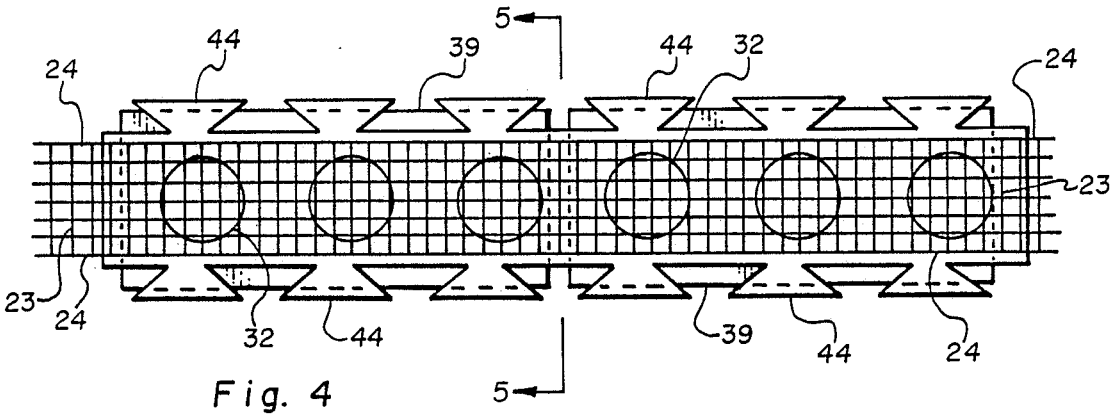
FIG. 4 is a plan view of an exposed course of glass blocks having a modified embodiment of a horizontal spacer and reinforcement member laying on the upper surfaces of the blocks.
Figure 5:
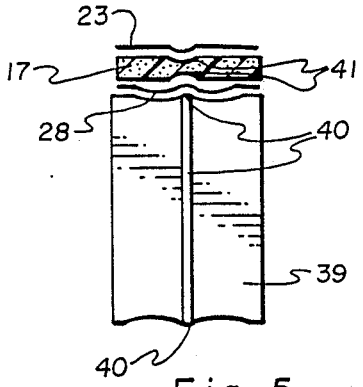
FIG. 5 is a vertical cross section taken along the line 5—5 of FIG. 4.

In the manufacture of common glass blocks, a fusion ridge 40 is developed encircling the central portion of the perimeter of the blocks as shown in FIG. 5. To accommodate this ridge 40, the slabs 17 of the spacer and fabric mesh reinforcement members of the present invention are advantageously provided with a central longitudinal groove 41 as shown in FIG. 4. The groove 41 fits over the fusion ridge 40 on the blocks, and the respective fabric meshes 23 and 28 conform to the groove 41.

A modified embodiment of the spacer and fabric mesh reinforcement member of the present invention is illustrated in FIG. 4. The modified embodiment of FIG. 4 is shown laying on a course of glass blocks 39. The basic width of the spacer and mesh member 12 is the same as in the previous embodiments described hereinbefore. In particular, the basic width of the slab 17 is less than the width of the glass blocks 39 with which the member 12 is to be used. However, to accommodate glass blocks of various widths and/or to provide a spacer member 12 which will extend from one edge of the glass block to the other a plurality of spaced apart projections 44 are provided which extend outwardly from each of the lateral sides of the slab 17. The projections 44 have a thickness which is the same as the thickness of the slab 17, with each projection 44 extending outwardly from a mutually respective side edge of the slab 17 by a sufficient distance, generally between about one-half inch to two inches, that the overall width of the slab 17 and projections 44 is no less than about one-half inch less than the width of the glass blocks 39.

The modified embodiment of the spacer and fabric mesh member as illustrated in FIG. 4 is advantageous in that it spans the entire width of the glass blocks 39 which are being used This facilitates quick and accurate placement of the fabric mesh members to provide uniform spacing between the glass blocks 39. When the laying of the wall structure is completed, the mason simply uses a pointing device to remove the projections 44 from all the visible joints between blocks 39. A final grout is then filled into the groove constituting the joints between the blocks 39 to complete the finished wall structure.

The fabric mesh used in the present invention can be made of almost any fiber material. The fibrous material can be natural fibers such as cotton, wool, etc. Advantageously, the fibrous material comprises synthetically made fibers such as polymeric fibers, glass fibers, carbon fibers, etc. In the preferred embodiment, the fiber mesh is made from fiber glass.

Figure 6:
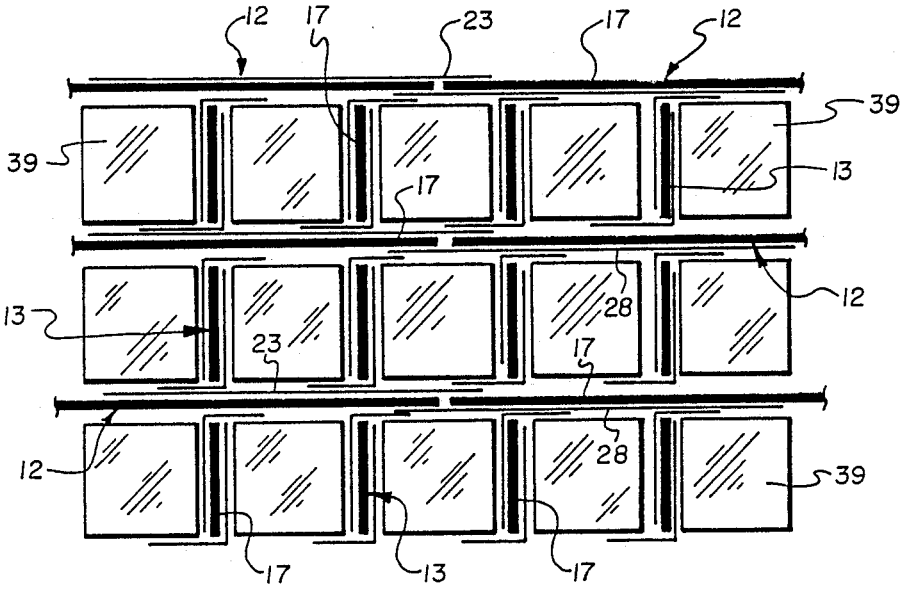
FIG. 6 is graphical representation of several courses of glass blocks showing the spacer and reinforcement members of the present invention in proper placement between the blocks.

A schematic representation of a wall structure formed in accordance with the present invention from a plurality of glass blocks 39 laid in successive courses is shown in FIG. 6. A plurality of lateral spacer and fabric mesh members 12 in accordance with the present invention are disposed in endto-end relationship between courses of glass blocks 39. The first ends of the respective slabs 17 of the lateral members 12 abut mutually respective second ends of adjacent slabs 17. The oppositely extending ends of the fabric meshes 23 and 28 associated with the lateral members 12 lie over and cover the upper and lower edges, respectively, of the butts formed by the abutting members 17.

As also illustrated in FIG. 6, the wall construction preferably includes vertical spacer and fabric mesh members 13 disposed vertically between adjacent blocks 39. The oppositely extending ends of the fabric meshes 23 and 28 associated with the vertical members 13 are bent in substantially right angles with respect to the vertical members 13, with one of the extensions projecting in one lateral direction and the other extension projecting in the opposite lateral direction. As can be seen from FIG. 4, the upper fabric mesh extension lies over the top of an adjacent block 39 and against the lateral spacer and fabric mesh member 12, and the lower fabric mesh extension lies against the bottom surface of the opposite adjacent block 39 and the lateral spacer and fabric mesh member 12.

The spacer and fabric mesh members 12 and 13 of the present invention are embedded simultaneously with the mortar used by the mason as he lays up the wall structure. It is preferable to use a thin set mortar as is readily available in the market. The mason can make his own thin set mortar by mixing portland cement, fine silica sand and a latex binder. Various proportions of the ingredients can be used as is well known in the masonry trade.

Although preferred embodiments of the spacer members 12 and 13, as well as the wall structure formed by using such members, have been illustrated and described, it is to be understood that the present disclosure is made by way of example and that various other embodiments are possible without departing from the subject matter coming within the scope of the following claims, which subject matter is regarded as the invention.

I claim:

1. A spacer and fabric mesh reinforcement member for masonry installation of glass blocks, comprising an elongate slab of a resilient, compressible material having substantially flat upper and lower surfaces, lateral side edges, first and second end edges and a desired thickness sufficient for the slab to act as a spacer between glass blocks;

an elongate piece of fabric mesh having first and second, lateral sides and opposite, first and second ends, with the width of said piece of mesh being no greater than the dimension between the lateral side edges of said slab, said piece of mesh being adhered to said slab so as to lie flat against one of said surfaces of said slab and extend longitudinally along said one of said surfaces, said piece of mesh further having a longitudinal length which is significantly greater than the longitudinal distance between the end edges of said slab, with the first end of said piece of mesh being positioned closer to said first end edge of said slab than to said second end edge of said slab, and with the second end of said piece of mesh extending from said second end edge of said slab.

2. A spacer and fabric mesh reinforcement member in accordance with claim 1, wherein at least two openings are spaced along the longitudinal length of said slab, with the openings extending through the slab from the upper surface to the lower surface thereof.

3. A spacer and fabric mesh reinforcement member in accordance with claim 2, wherein a central longitudinal groove is provided on each of the upper surface and lower surface of said slab.

4. A spacer and fabric mesh reinforcement member in accordance with claim 2, wherein the width of said slab between lateral side edges thereof is less than the width of the glass blocks with which the spacer and fabric mesh reinforcement is to be used, and the slab is provided with a plurality of spaced apart projections extending outwardly from each of the lateral side edges, said spaced apart projections having a thickness which is the same as the thickness of said slab, with each projection extending outwardly from a mutually respective side edge of said slab by a sufficient distance that the overall width of said slab and projections is no less than about one-half inch less than the width of the glass blocks with which the spacer and fabric mesh reinforcement is to be used.

5. A spacer and fabric mesh reinforcement member in accordance with claim 1, wherein the mesh is made from a fibrous material comprising natural fibers or synthetically made fibers.

6. A spacer and fabric mesh reinforcement member in accordance with claim 5, wherein the mesh is made from fiber glass.

7. A spacer and fabric mesh reinforcement member in accordance with claim 2, wherein the fabric mesh are adhered to the respective upper and lower surfaces of said slab with any suitable adhesive.

8. A wall structure formed from a plurality of glass blocks laid in successive courses and a plurality of first spacer and fabric mesh reinforcement members in accordance with claim 2 disposed in end-to-end relationship between courses of glass blocks in said wall structure, wherein the longitudinal distance between the end edges of each of said slabs comprising said first spacer and fabric mesh reinforcement members is at least twice the horizontal length of individual glass blocks, and the respective first end edges of said slabs abut respective second end edges of mutually adjacent slabs, with the extending portion of said second end of said piece of fabric mesh of each respective slab lying flatwise on a surface of a mutually respective adjacent slab to cover the juncture between the upper surfaces of the first and second end edges of said mutually adjacent slabs.

9. A wall structure in accordance with claim 8, further comprising a plurality of second spacer and fabric mesh reinforcement members in accordance with claim 2, wherein the longitudinal distance between the end edges of each of said slabs comprising said second spacer and fabric reinforcement members is no greater than the vertical height of individual glass blocks, with the second spacer and fabric reinforcement members being disposed vertically between adjacent blocks in the wall structure, and wherein the extending portion of said second end of said piece of fabric mesh of each respective slab is bent in a substantially right angle with respect to the mutually respective end edge of the slab.

10. A spacer and fabric mesh reinforcement member for masonry installation of glass blocks, comprising an elongate slab of a resilient, compressible material having substantially flat upper and lower surfaces, lateral side edges, first and second end edges and a desired thickness sufficient for the slab to act as a spacer between glass blocks;

a first, elongate piece of fabric mesh having first and second, lateral sides and opposite, first and second ends, with the width of said first piece of mesh being no greater than the dimension between the lateral side edges of said slab, said first piece of mesh being adhered to said slab so as to lie flat against the upper surface of said slab and extend longitudinally along said upper surface, said first piece of mesh further having a longitudinal length which is significantly greater than the longitudinal distance between the end edges of said slab, with the first end of said first piece of mesh being positioned closer to said first end edge of said slab than to said second end edge of said slab, and with the second end of said first piece of mesh extending from said second end edge of said slab; and a second, elongate piece of fabric mesh having first and second, lateral sides and opposite, first and second ends, with the width of said second piece of mesh being no greater than the dimension between the lateral side edges of said slab, said second piece of mesh being adhered to said slab so as to lie flat against the lower surface of said slab and extend longitudinally along said lower surface, said second piece of mesh further having a longitudinal length which is significantly greater than the longitudinal distance between the end edges of said slab, with the first end of said second piece of mesh being positioned closer to said second end edge of said slab than to said first end edge of said slab, and with the second end of said second piece of mesh extending from said first end edge of said slab.

* * * * *